United States Patent [19]

Noh

[11] Patent Number: 4,858,450

[45] Date of Patent: Aug. 22, 1989

[54] STIRRING DEVICE FOR AUTOMATIC WASHER

[75] Inventor: Yang H. Noh, Pusan, Rep. of Korea

[73] Assignee: Gold Star Col, Ltd., Seoul, Rep. of Korea

[21] Appl. No.: 159,456

[22] Filed: Feb. 18, 1988

Related U.S. Application Data

[63] Continuation of Ser. No. 844,124, Mar. 26, 1986, abandoned.

[30] Foreign Application Priority Data

Mar. 27, 1985 [KR] Rep. of Korea ..... 85-2044[U]
Mar. 27, 1985 [KR] Rep. of Korea ..... 85-3252[U]

[51] Int. Cl.[4] ..... D06F 17/10
[52] U.S. Cl. ..... 68/134
[58] Field of Search ..... 68/133, 134

[56] References Cited

U.S. PATENT DOCUMENTS

| | | | |
|---|---|---|---|
| 1,897,239 | 2/1933 | Chapman | 68/133 |
| 1,923,580 | 8/1933 | Nelson | 68/134 X |
| 2,042,578 | 6/1936 | Behan | 68/134 |
| 2,150,654 | 3/1939 | Geldhof | 68/134 |
| 2,228,057 | 1/1941 | Kirby | 68/134 X |
| 2,734,367 | 2/1956 | Geldhof | 68/133 |
| 3,117,434 | 1/1964 | Byrd et al. | 68/134 |
| 3,464,239 | 9/1969 | Hubbard et al. | 68/134 |
| 3,726,114 | 4/1973 | Ahmad | 68/134 |

FOREIGN PATENT DOCUMENTS

| | | | |
|---|---|---|---|
| 824333 | 12/1951 | Fed. Rep. of Germany | 68/134 |

*Primary Examiner*—Philip R. Coe
*Attorney, Agent, or Firm*—Birch, Stewart, Kolasch & Birch

[57] ABSTRACT

A stirring device for an automatic washer which comprise a washing tub disposed in the automatic washer, a circular base plate, a stirring blade member extending vertically from the center of one surface of the circular base plate. The stirring blade member includes blades wherein each of the blade has a helical configuration undulating from a top surface to an underlying bottom surface, and protrusion extending across the top surface whereby the stirring blade member imparts to the wash material an impactive drying action while suppressing upward movement of the wash material.

1 Claim, 5 Drawing Sheets

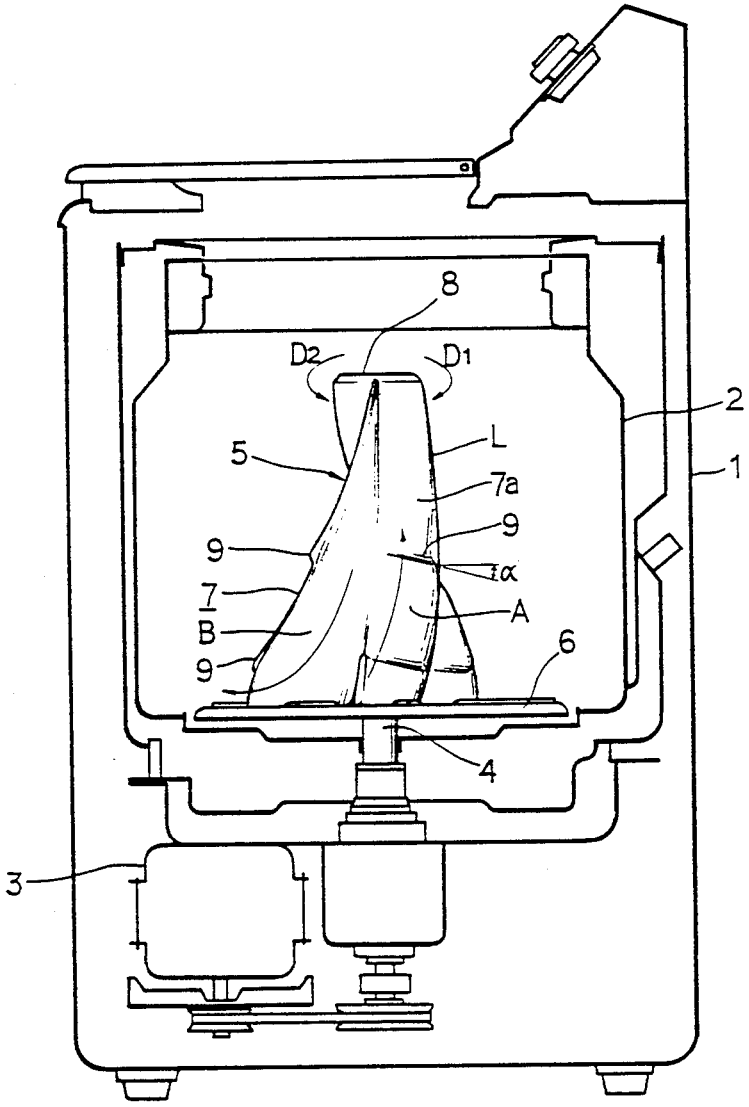
FIG, 1

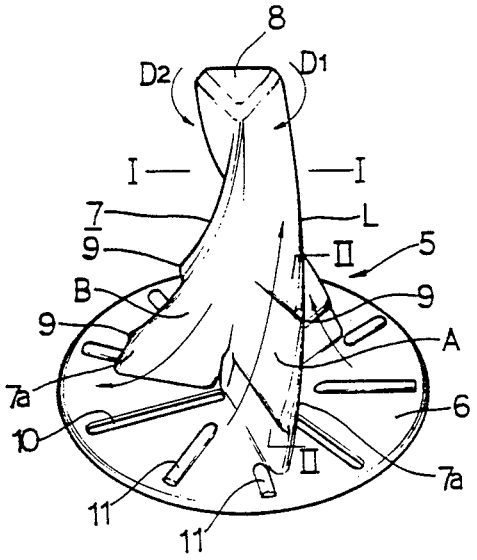
FIG,2
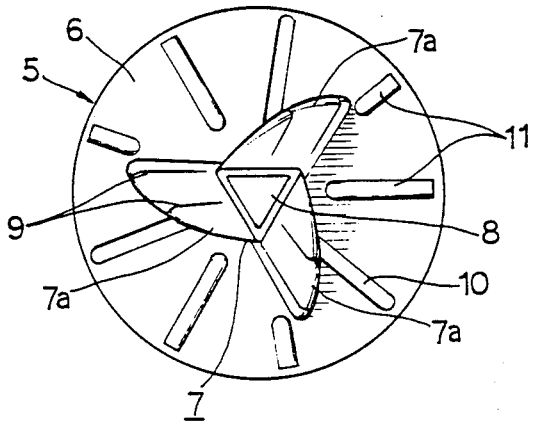
FIG,3

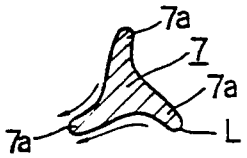
FIG,4
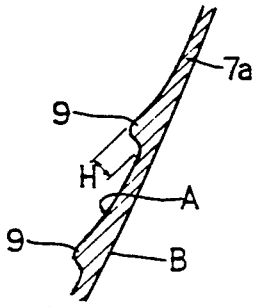
FIG,5
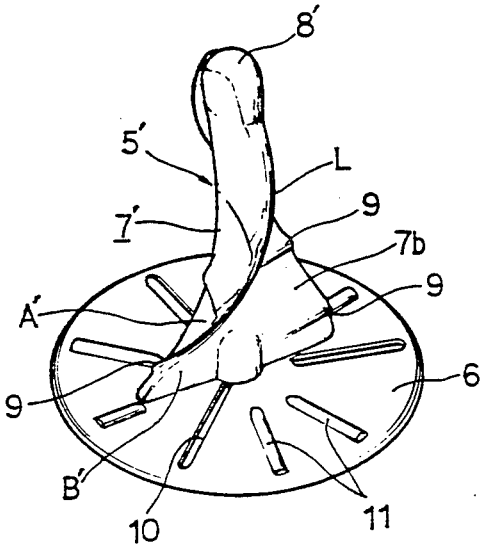
FIG,6

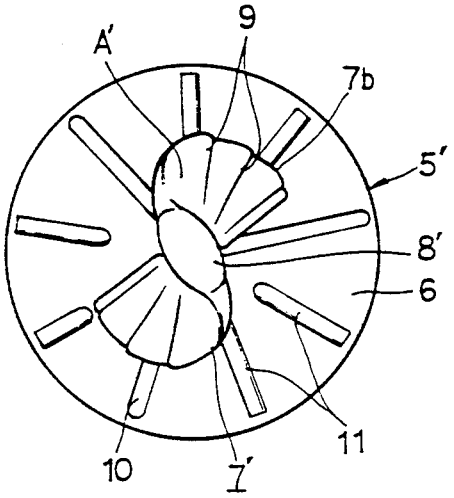
FIG,7
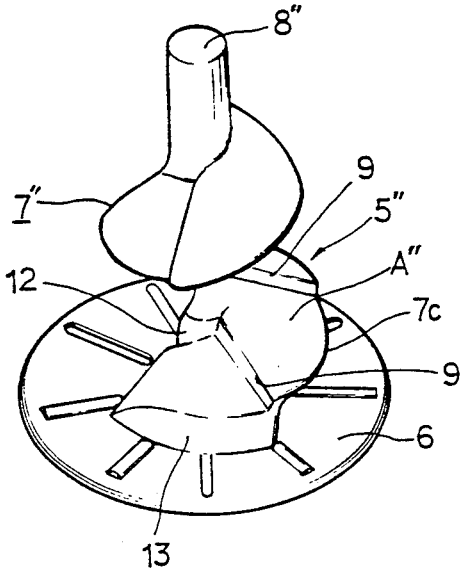
FIG,8

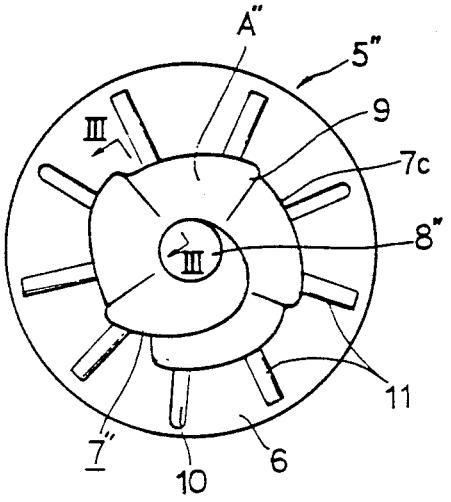
FIG,9
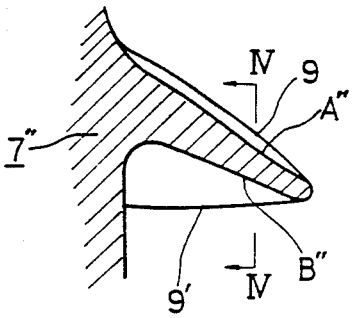
FIG,10
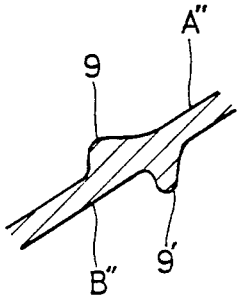
FIG,11

STIRRING DEVICE FOR AUTOMATIC WASHER

This application is a continuation of application Ser. No. 844,124 filed on Mar. 26, 1986, and now abandoned.

BACKGROUND OF THE INVENTION

1. Field of the Invention

The present invention relates to a stirring device for an automatic washer, and more particularly to a stirring device rotatably mounted in the interior of washing tub of an automatic washer and comprising stirring blades with an improved shape.

2. Description of the Related Art

Generally, in a stirring type automatic washer in which a stirring device or agitator is disposed within a washing tub and alternately rotated in normal and reverse directions, the washing power exerted to the materials of washing and the degree of entanglement of the materials of washing greatly depend upon the construction and shape of the stirring blades of the stirring device, the mounting position of the stirring device in the washing tub, and the rotation cycle of the stirring device.

As a conventional device applied to such a agitating type automatic washer, for example, there is a construction wherein a plurality of stirring blades are mounted on the upper surface of a circular base plate and extended outwardly and radially from the center of the base plate. There is also a construction wherein a rotating rod having a cylindrical or conical shape is vertically mounted on the center of the upper surface of circular base plate and provided with a plurality of stirring blades at the outer surface thereof. In this construction, stirring blades may be vertically extended from the rod and spaced uniformly from one another. Alternatively, a single stirring blade may be used, which helically extends throughout the length of the rotating rod and around the outer surface thereof.

In the former construction comprising a plurality of stirring blades radially protruded from the upper surface of circular base plate, the vertical flow of washing materials is smoothly carried out by virtue of the rolling of the washing materials generated by the function of stirring blades to wind the materials around the blades. However, this action of the stirring blades also causes the washing material to be entangled and thereby lumped, so that washing power is insufficiently transmitted to the inner part of the lump of materials of washing. Due to the entanglement of the washing materials, it is inconvenient to take up the materials from the washing tub after the washing is completed. In addition, there is a drawback that severe vibrations are generated during the dehydration operation.

On the other hand, in the latter construction comprising vertical stirring blades mounted on a rotating rod, the wash materials are wound around the rotating rod when the amount of the materials is large, so that a flow of the materials from the center portion toward the outer portion can not be smoothly carried out thus, the materials can not be uniformly washed. In the construction comprising a helical stirring blade disposed on the outer surface of a rotating rod, vertical and radial flows of the wash materials can be smoothly carried out. In this case, however it is hard to eliminate the problem that the wash materials are wound around the rotating rod. Since the wash materials rise very easily and rapidly, there is a disadvantage of reducing the stirring efficiency of the washing tub at the bottom portion effecting greatly the stirring power.

In addition to the above-mentioned stirring devices, many proposals have been made, all of which in various ways change the shape and construction of stirring blade in order to improve the washing power and eliminate the entanglement of the wash materials. However, they are all unable to provide an effect sufficient to improve the washing power and simultaneously eliminate the above-mentioned entanglement.

SUMMARY OF THE INVENTION

Therefore, an object of the present invention is to provide an agitator or stirring device for an automatic washer capable of eliminating the problems and disadvantages encountered in the above-mentioned conventional stirring devices, improving the efficiency of washing.

A further object of the present invention is to provide a stirring device of an automatic washer designed such that as the stirring device rotates in a normal or reverse direction within the stirring tub, the wash materials ascend and descend slidably and smoothly along the surface of the stirring blade to avoid instantaneous overloading.

Another object of the present invention is to provide a stirring device or agitation of automatic washer comprising a stirring blade with a construction such that during normal of reverse rotation of the stirring device, a radial flow of the wash materials is smoothly carried out, as well as the vertical flow of the materials and that the wash materials are subjected to a force in a direction outwardly away from the center portion of stirring device, thereby preventing them from being wound around the rotation rod.

Yet another object of the present invention is to provide a stirring device which enables stirring action on the wash materials generated at the upper portion of the stirring device, so that the washing action is effectively carried out on the wash materials which are likely to rise in the water.

Still another object of the present invention is to provide a stirring device wherein when the materials of washing rise along the inclined surfaces of the stirring blades during the washing thereof, they are subjected to an instantaneous impact action, thereby causing the washing power to increase and prevent the wash materials from to rapidly using in order to reduce the floating of wash materials on the water surface.

According to the present invention, these objects are accomplished by providing a stirring device or agitator of an automatic washer comprising an helical stirring blade vertically disposed on the center portion of the upper surface of circular base plate, along the center axis of the base plate, the blade being shaped such that as the blade extends from the bottom thereof to the top thereof, the width of blade is gradually narrowed.

The stirring or agitating blade may be of a single blade-type wherein a single blade is integrally formed at the bottom end portion thereof with the circular base plate and provided with a helical inclined surface extending from the bottom end of stirring blade to the top end thereof. Alternatively, the stirring blade may be of the double blade-type comprising two stirring blades provided with two inclined surfaces extending in opposite directions at positions of symmetry, respectively. Further, the stirring blade may be of the triple blade type wherein three stirring blades are arranged in three directions.

According to the present invention, the stirring device includes a plurality of protrusions formed on the surface of the stirring blade, extended in a direction of the width of the stirring blade.

The present invention can be more fully understood from the following detailed description when taken in conjunction with the accompanying drawings.

BRIEF DESCRIPTION OF THE DRAWINGS

FIG. 1 is a schematic sectional view of an automatic washer provided with a stirring device in accordance with an embodiment of the present invention;

FIG. 2 is a perspective view of a stirring device in accordance with an embodiment of the present invention;

FIG. 3 is a plan view of the stirring device shown in FIG. 2;

FIG. 4 is a cross-sectional view taken along the line I—I in FIG. 2;

FIG. 5 is a cross-sectional view taken along the line II—II in FIG. 2;

FIG. 6 is a perspective view of a stirring device in accordance with the other embodiment of present invention;

FIG. 7 is a plan view of the stirring device shown in FIG. 6;

FIG. 8 is a perspective view of a stirring device in accordance with another embodiment of the present invention;

FIG. 9 is a plan view of the stirring device shown in FIG. 8;

FIG. 10 is a cross-sectional view taken along the line III—III in FIG. 9; and FIG. 11 is a cross-sectional view taken along the line V—V in FIG. 10.

DETAILED DESCRIPTION OF THE INVENTION

In FIG. 1, there is seen a automatic washer 1 and a washing tub 2 disposed in the interior of the automatic washer 1. A washing shaft 4 is vertically mounted on the center portion of a bottom surface of the washing tub 2 to be driven by a drive motor 3. A stirring device 5 according to the present invention is mounted on the top end of washing shaft 4 to rotate within the washing tub 2.

FIGS. 2 and 3 show a stirring device of the triple blade-type in accordance with an embodiment of the present invention. The stirring device 5 comprises a circular base plate 6 and a triple blade-type stirring blade 7 vertically mounted on the center portion of the upper surface of the base plate 6 along the center axis of the base plate 6. The stirring blade 7 includes three blade members *7a* of the same shape. These blade members *7a* are arranged to extend from the center of the base plate 6 in three directions, respectively, uniformly spaced from one another. Each blade member *7a* is integrally formed at the lower end thereof with the base plate 6 and are shaped such that as the blade member extends upward, the width thereof is gradually reduced. Each blade member *7a* is helically extended to form the inclined surfaces A and B with a certain slope from the center axis of the base plate 6. The three blade members are terminated together at the respective top ends thereof to form a rod member 8 substantially shaped into a triangle. These blade members *7a* are joined together at the respective inner edges thereof to form an integral part and provided at the respective outer edges thereof with helically curved tip lines L.

From one inclined surface A of each blade member *7a*, a plurality of protrusions 9 are protruded to extend from the tip line L in a direction of the width of blade member *7a*. The number of protrusions is from one to five for every blade member. The orientation of protrusions is determined such that an angle $\alpha$ between the tip line L and each protrusion is $0° \leqq \alpha \leqq 90°$ (FIG. 1). Although determined depending upon the size of stirring device, the height H of each protrusion 9 is substantially $5\ mm \leqq H \leqq 25\ mm$ (FIG. 5). The height H of protrusion may be uniform for all protrusions, or alternatively, may be varied to a gradual reduction at the upper protrusions. Although not shown in the drawings, the center portion of the bottom surface of the circular base plate 6 is constructed to be easily mounted to the washing shaft 4. On the upper surface of the base plate 6, a plurality of slits 10 and a plurality of reinforcing ribs 11 are formed, alternately.

The stirring device 5 having the above-mentioned construction according to the present invention is mounted on the washing shaft 4. When the washing shaft 4 rotates in a normal direction, that is the stirring device 5 rotates in a direction indicated by an arrow $D_1$, the wash material rises along the inclined surface A of each blade member *7a* of the blade 7 (FIG. 2). Simultaneously, the wash material is subjected to a rotating and stirring action by the tip line L of each blade member. On the other hand, when the wash shaft 4 rotates in a reverse direction, that is, the stirring device 5 rotates in a direction indicated by an arrow $D_2$, the wash material descends along the inclined surface B of each blade member *7a* (FIG. 2). Simultaneously, the wash material is subject to a rotating and stirring action by the tip line L of each blade member. Accordingly, the vertical and radial flow of the wash material is smoothly carried out, so that the washing power can be uniformly transmitted throughout the wash material.

Since both surfaces of each blade member *7a* of blade 7 form the inclined surfaces A and B, respectively, the wash material slides along the inclined surface surfaces A or B during the flow thereof, thereby preventing the blade member from being instantaneously subjected to an overload. Furthermore, as the stirring device 5 rotates in the normal or reverse direction, the wash material is guided in a direction outwardly away from the center of the stirring device, together with the ascension or descension thereof, because the curved surface is defined by adjacent blade members *7a* of the blade 7, as shown in FIG. 4. Therefore, there is no disadvantage that only a certain part of the wash material is continuously washed, as the material of washing is wound around the rotating rod, as encountered in the prior art.

In addition, the wash stirring action on the material can be efficiently provided because the upper ends of blades 7 forms the rod member 8 substantially shaped into a triangle. Accordingly, even for the wash material which is likely to catch air introduced in the interior thereof and thus float on the water, such as a jumper, the stirring device easily catches the wash material at the upper portion thereof and then takes it down for washing. Also, the stirring action is strong, so that even somewhat thick clothes or blankets can be effectively washed.

Particularly, each blade member *7a* is provided at the inclined surface A with a plurality of protrusions 9 extending in a direction of the width of the blade member in accordance with the present invention, so that when the wash material slideablely ascends along the surface of each stirring or agitating blade member, it is subjected to an instantaneous impact force by being run against the protrusions at a high velocity, thereby causing the washing power to increase and preventing the wash material from rapidly rising in order to reduce the floating of the wash material on the water surface. Also, it is possible that the wash material is continuously subjected to the stirring action at the lower portion of the stirring device where a large stirring force is exerted.

FIGS. 6 and 7 are perspective and plan views, respectively, showing a double blade-type stirring device 5' in accordance with an alternate embodiment of present invention. As the stirring device 5 of the above-mentioned embodiment, the stirring device 5' comprises a circular base plate 6 and a double an alternate stirring blade 7' vertically mounted on the center portion of the upper surface of the base plate 6, along the center axis of the base plate 6. The stirring blade 7' comprises two blade members *7b* with a same shape, arranged symmetrically in opposite directions from the center of the base plate 6. Each blade member *7b* is integrally formed at the lower end thereof with the base plate 6 and shaped such that as the blade member extends upwardly, the width thereof is gradually reduced. The blade members are joined together to form an integral part and are formed at the upper ends thereof into an oval rod member 8'.

A plurality of protrusions 9 are formed on the surface A of each blade member *7b* in a manner as in the above-mentioned embodiment.

Accordingly, it can be understood that the stirring device 5' of this embodiment provides a washing action and effect similar to that of the stirring device 5 of the above-mentioned embodiment, so that a discussion of the detailed action and effect, according to this embodiment, is not necessary.

FIGS. 8 and 9 show a single blade-type stirring device 5'' in accordance with another embodiment of the present invention. The stirring device 5'' comprises a circular base plate 6 and a single blade-type stirring blade 7'' vertically mounted on the center portion of the upper surface of the base plate 6. The stirring blade 7'' comprises a blade member *7c* integrally formed at the lower end thereof with the base plate 6 and supported at the end to a short support rod 12 vertically mounted on the center portion of the upper surface of the base plate 6. The blade member *7c* extends helically and upwardly. The blade member *7c* is also provided at the top end thereof with a rod member 8'' arranged in alignment with the support rod 12. The rod member 8'' and the support rod 12 are connected by the blade member *7c* to eliminate a rod part between the rod member 8'' and the support rod 12. The blade member *7c* has a slope which is steep near to 90°, at the upper portion thereof and is gradually decreased as the blade member extends downwardly. A plurality of protrusions 9 and 9' are formed on the inclined surfaces A'' and B'' of the blade member *7c* in a manner as in the above-mentioned embodiment.

The blade member *7c* is provided at one side of the lower end thereof with a guiding lateral wall 13 extending to the circular base plate 6, so that the wash material is easily guided when the stirring device 5'' rotates. A rotating drive power is transmitted to the stirring blade 7'' by means of the support rod 12. In this stirring device 5'', a rod member 8'' is formed at the upper end of the blade member *7c* and arranged in alignment with the axis of the support rod 12 in order to maintain the position of the rotation center of the whole stirring device on the rotation axis. As a result, there is no vibration caused by the eccentricity of the stirring device during the rotation thereof. The blade member *7c* has a progressive steep slope as it extends upwardly, so that the wash material easily falls along the upper surface of the blade member *7c*, thereby preventing the vibration which may be generated when the wash material is caught around the upper portion of the stirring device during the dehydrating operation.

The stirring device of this embodiment also provides a washing action and effect similar to that of the stirring device of the above-mentioned embodiments, so that the detailed action and effect according to this embodiment need not be discussed here.

While the present invention has been described with reference to preferred embodiments, it will be understood by those skilled in the art that various changes may be made for the number of blade members, the curved direction of the blades, and the shapes of the upper portion of the blade member and the protrusion, without departing from the object and scope of the invention as defined by the appended claims.

What is claimed is:

1. A stirring device for an automatic washer which comprises:

a circular base plate, a stirring blade member having length and width, said stirring blade member extending vertically from the center of one surface of said circular base plate, said stirring blade member including three helical blades, said three helical blades being undulated to extend from the center of said circular base plate upward in three directions, joined together at inner edges thereof to form an integral part, provided at respective outer edges thereof with helically curved tip lines, and concentrated together at top ends thereof to form a rod member substantially shaped into a triangle, rib members uniformly disposed on and extending vertically from said one surface of said circular base plate, and at least one protrusion member extending in a direction along the width of and across the top surface of each blade, and intersecting the tip line of the blade with an angle between the tip line and each protrusion being less than about 90° whereby said stirring blade member imparts to the material being washed an impactive drying action while suppressing the upward movement of said material.

* * * * *